US011605511B2

(12) United States Patent
Dobashi et al.

(10) Patent No.: US 11,605,511 B2
(45) Date of Patent: Mar. 14, 2023

(54) CONTROL APPARATUS, OPERATION UNIT, AND ELECTRONIC APPARATUS

(71) Applicant: CANON KABUSHIKI KAISHA, Tokyo (JP)

(72) Inventors: Hideki Dobashi, Kanagawa (JP); Takashi Yoshida, Kanagawa (JP); Shinsaku Watanabe, Kanagawa (JP); Shingo Iwatani, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/356,788

(22) Filed: Jun. 24, 2021

(65) Prior Publication Data

US 2021/0407744 A1 Dec. 30, 2021

(30) Foreign Application Priority Data

Jun. 29, 2020 (JP) ..... JP2020-111098
Jun. 29, 2020 (JP) ..... JP2020-111108

(51) Int. Cl.
*H01H 3/00* (2006.01)
*H01H 3/08* (2006.01)
*H01H 3/12* (2006.01)

(52) U.S. Cl.
CPC ..... *H01H 3/00* (2013.01); *H01H 3/08* (2013.01); *H01H 3/12* (2013.01); *H01H 2003/008* (2013.01); *H01H 2215/05* (2013.01)

(58) Field of Classification Search
CPC .. H01H 3/00; H01H 3/08; H01H 3/12; H01H 2003/008; H01H 2215/05; A63F 13/00; A63F 2300/1037; G05G 1/00; G05G 1/08; G05G 1/10; H03K 17/90; H03K 17/965; H03K 17/97; H03K 17/9703; G06F 3/01; G06F 3/016; G06F 3/03; G06F 3/0338; F16D 2121/20
See application file for complete search history.

(56) References Cited

U.S. PATENT DOCUMENTS 8,360,882 B2 * 1/2013 Liu ..... A63F 13/24 463/47

FOREIGN PATENT DOCUMENTS

JP 2017-167603 A 9/2017

* cited by examiner

*Primary Examiner* — Anthony R Jimenez
(74) *Attorney, Agent, or Firm* — Cowan, Liebowitz & Latman, P.C.

(57) ABSTRACT

A control apparatus includes a main body unit, a plurality of moving members each of which is movably supported by the main body unit, a magneto rheological fluid provided between the main body unit and each of the plurality of moving members or between each of the plurality of moving members, and one magnetic field generator configured to apply a magnetic field to the magneto rheological fluid.

4 Claims, 11 Drawing Sheets

CONTROL APPARATUS, OPERATION UNIT, AND ELECTRONIC APPARATUS

BACKGROUND OF THE INVENTION

Field of the Invention

The present disclosure relates to a control apparatus, an operation unit, and an electronic apparatus.

Description of the Related Art

An electronic apparatus includes an operation member, such as a dial and a slide lever, for changing a control value. Among these operation members, there is an operation member including rubber or highly viscous grease at a slidable portion so as to moderately increase sliding torque of the operation member and to be rotated with a comfortable feeling. Further, there is an operation member including a click structure so as to provide one click feeling for each time when a control value is changed by one. Each of those is devised so that an operational feeling of the operation members is improved.

A control apparatus using an MR fluid (magneto rheological fluid) has been proposed as an apparatus which controls the operational feeling of such an operation member. The MR fluid is a fluid in which fine powders having diameters of about 10 μm of ferromagnetic material such as iron is dissolved in solvent such as oil. The MR fluid has a characteristic that when a magnetic field is applied to the MR fluid, the powders bond with each other and increase viscosity of the MR fluid. The MR fluid has a further characteristic that the viscosity increases as the magnetic field becomes stronger, and therefore the viscosity can be controlled by controlling the strength of the magnetic field.

A well-known configuration as an operational feeling control apparatus using the MR fluid is a configuration in which the MR fluid is provided around a rotational moving body, which is a rotor, a coil is disposed in the vicinity of the rotor, and a current flowing through the coil is changed for changing rotational torque of the rotor. By connecting an operation unit such as a dial to this rotor, a feeling of rotation can be freely changed.

Japanese Patent Application Laid-Open No. 2017-167603 proposes a device which controls operational feelings of a plurality of operation members by arranging such an operational feeling control apparatus depending on an operation on each operation member.

Such an operational feeling control apparatus includes one rotor and one coil, and thus a plurality of operational feeling control apparatuses are required so that the feelings are controlled for the plurality of operation members.

However, if the operational feeling control apparatus is provided for each of the plurality of operation members of the electronic apparatus, the device becomes large and the cost increases.

SUMMARY OF THE INVENTION

The present disclosure provides a low-cost and small-sized control apparatus using a magneto rheological fluid. Further, the present disclosure provides a low-cost and small-sized electronic apparatus in which operational feelings of a plurality of operation members can be changed depending on a preference by using the above control apparatus in the electronic apparatus.

The present disclosure provides a low-cost and small-sized operation unit in which a plurality of operation members including a linear operation member are controlled by one control apparatus, and an electronic apparatus having the same.

A control apparatus according to one aspect of the present disclosure includes a main body unit, a plurality of moving members each of which is movably supported by the main body unit, a magneto rheological fluid provided between the main body unit and each of the plurality of moving members or between each of the plurality of moving members, and one magnetic field generator configured to apply a magnetic field to the magneto rheological fluid.

An electronic apparatus according to another aspect of the present disclosure includes a plurality of operation members, and the above control apparatus. The plurality of operation members and the plurality of moving members are connected to each other on a one-to-one basis.

An operation unit according to one aspect of the present disclosure includes a control apparatus having a main body unit, a rotational member which is rotatably supported by the main body unit, a magneto rheological fluid provided between the main body unit and the rotational member, and a magnetic field generator configured to apply a magnetic field to the magneto rheological fluid, a linear operation member which operates by linearly moving, a rotational operation member which operates by rotationally moving, a first connection member configured to transmit a driving force of the rotational member to the linear operation member, and a second connection member configured to transmit the driving force of the rotational member to the rotational operation member. The control apparatus is configured to control operational feelings of the linear operation member and the rotational operation member.

An electronic apparatus according to another aspect of the present disclosure includes the above operation unit.

Further features of the present invention will become apparent from the following description of exemplary embodiments with reference to the attached drawings.

DESCRIPTION OF THE EMBODIMENTS

Referring now to the accompanying drawings, a description will be given of embodiments according to the present disclosure.

First Embodiment

Figure 1:
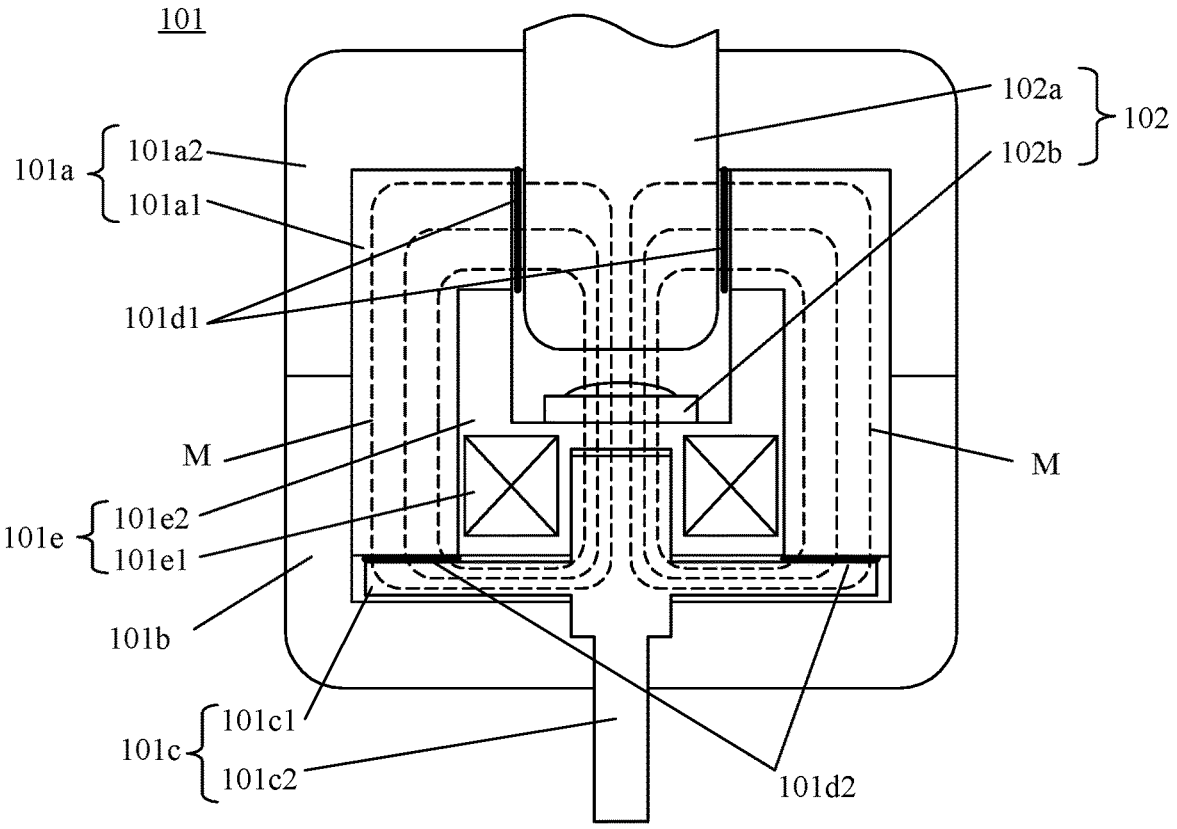
FIG. 1 is a sectional view illustrating an operational feeling control apparatus according to a first embodiment of the present disclosure.

FIG. 1 is a sectional view illustrating an operational feeling control apparatus 101 as a control apparatus for realizing the embodiment of the present disclosure.

A main body unit of the operational feeling control apparatus 101 includes a first main body unit 101*a* and a second main body unit 101*b* each of which also serves as a casing. The first main body unit 101*a* has a structure in which a core portion 101*a*1 and a cover portion 101*a*2 form two bodies.

In this configuration, the core portion 101*a*1 is made of magnetic material such as iron, and the cover portion 101*a*2 is made of non-magnetic material such as resin material. The second main body unit 101*b* has the same configuration as the cover portion 101*a*2 of the first main body unit 101*a*. The first main body unit 101*a* and the second main body unit 101*b* May be Made of the Same Material and May be integrated.

An inner cylinder portion 101*e* is inserted inside the core portion 101*a*1. The inner cylinder portion 101*e* has an integrated structure of a coil 101*e*1 and a holder portion 101*e*2 by enclosing the coil 101*e*1 as a magnetic field generator with the holder portion 101*e*2 of resin material.

A push-button shaped button apparatus 102 is disposed on a space surrounded by the first main body unit 101*a* and the inner cylinder portion 101*e*, the button apparatus 102 being an operation member for which a feeling is controlled. The button apparatus 102 has a configuration of a push button type switch which is a linear operation member and which can linearly move by sliding in the vertical direction of FIG. 1. The button apparatus 102 includes a key top 102*a* which is a linearly moving member and a switch 102*b* which is a switch member, and is configured to turn on a switch when the key top 102*a* presses the switch 102*b*. Electric on/off of the switch is changed by an operation on the switch 102*b*. A gap is formed between the key top 102*a* and the core portion 101*a*1, and an MR fluid 101*d*1 is provided in this gap. The key top 102*a* is basically made of magnetic material, but the portion of magnetic material may be the whole or may be only a tip portion on which the magnetic field acts.

The inner cylinder portion 101*e* is configured to rotatably support a first rotor 101*c*, which is a rotational member configured to control a feeling of a rotational operation member. A gap is formed between a disc portion 101*c*1 of the first rotor 101*c* and the core portion 101*a*1, and an MR fluid 101*d*2 is provided in this gap. The first rotor 101*c* is made of magnetic material, but a rotor shaft portion 101*c*2 connected to the outside may be made of non-magnetic material.

The second main body unit 101*b* is attached as a casing for sealing the first rotor 101*c*, and the second main body unit 101*b* is configured to be used as a rotation support member for the first rotor 101*c*.

In the operational feeling control apparatus 101 having such a configuration, when a current flows in the coil 101*e*1, a magnetic field M as indicated by dotted lines in FIG. 1 is generated. Since the MR fluids 101*d*1 and 101*d*2 are provided in areas through which the magnetic field M passes, viscosity can be changed by an effect of the magnetic field M. When the viscosity of the MR fluid 101*d*1 increases, viscous resistance occurs when the key top 102*a* linearly moves, and when the viscosity of the MR fluid 101*d*2 increases, viscous resistance occurs between the disc portion 101*c*1 and the MR fluid 101*d*2 when the first rotor 101*c* rotates. The MR fluids 101*d*1 and 101*d*2 have characteristics that each viscosity increases as a current value flowing through the coil 101*e*1 increases, and thus the viscous resistance of each of them can be changed by changing the current value flowing through the coil 101*e*1.

Figure 2:
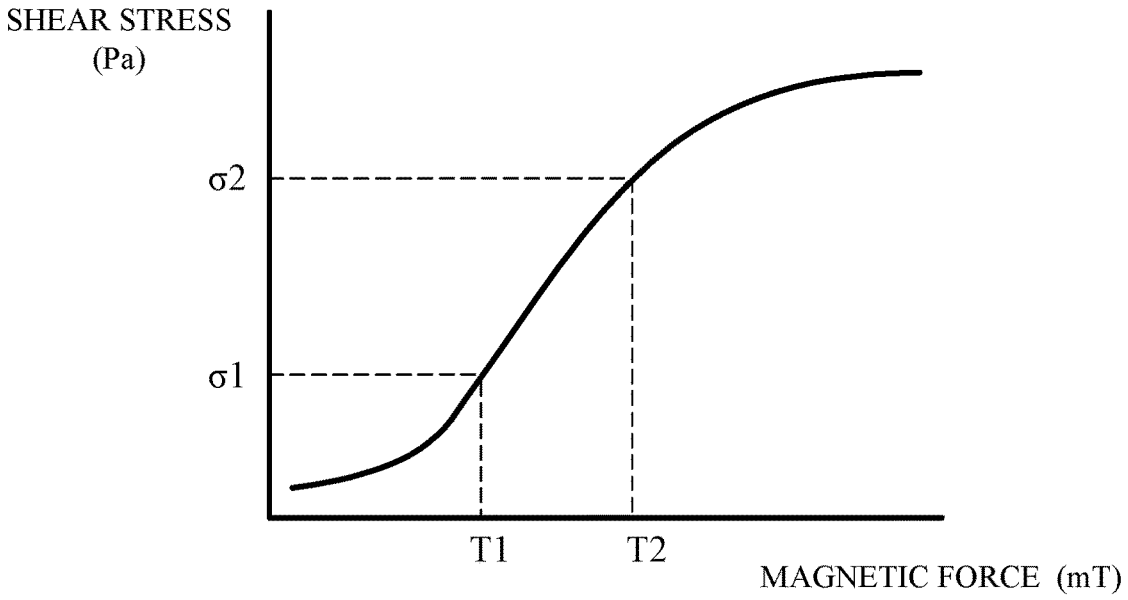
FIG. 2 is a diagram illustrating a relationship between a magnetic force applied to an MR fluid and a shear stress of the MR fluid.

Here, an operation principle will be described using the MR fluid 101*d*2. As illustrated in FIG. 2, when the current flowing through the coil 101*e*1 is T1, a shear stress of the MR fluid 101*d*2 becomes $\sigma 1$, and rotational resistance R1 occurs in the first rotor 101*c*. Further, when the current flowing through the coil 101*e*1 is T2 which is higher than T1, the shear stress of the MR fluid 101*d*2 becomes $\sigma 2$ which is higher than $\sigma 1$, and the rotational resistance R2 (R2>R1) occurs in the first rotor 101*c*. Thus, a larger force is required for rotating the first rotor 101*c* as compared with the case where the current flowing through the coil 101*e*1 is set to T1, and thus the operational feeling of the operation member connected to the first rotor 101*c* can be made heavier, that is, harder.

Figures 3A, 3B:
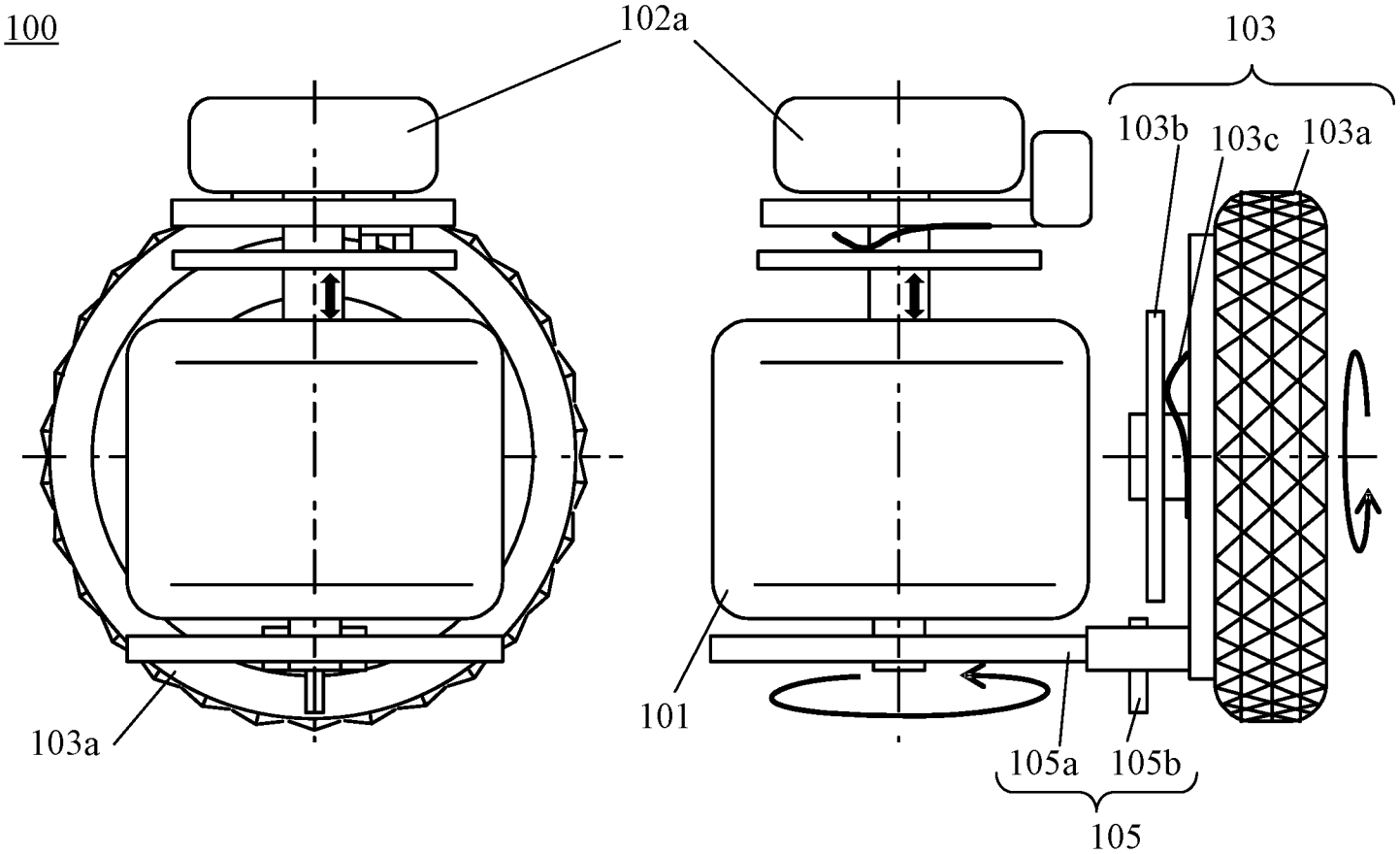
FIGS. 3A and 3B are diagrams each illustrating an example of an electronic apparatus using the operational feeling control apparatus according to the first embodiment of the present disclosure.

As an example of an electronic apparatus using the operational feeling control apparatus 101 of this configuration, FIGS. 3A and 3B illustrates operation members around a release of a camera to which the operational feeling control apparatus 101 of this configuration is applied. In the configurations illustrated in FIG. 1 and FIGS. 3A and 3B, the button apparatus 102 is a release apparatus, the key top 102*a* which is a linear operation member is a release button, and the switch 102*b* is a release switch. As described above, the key top 102*a* is inserted into the operational feeling control apparatus 101.

A first rotation operation apparatus 103 includes a dial 103*a* which is a dial shaped rotational operation member, a first substrate 103*b*, and a dial brush 103*c* attached to the dial 103*a*. A contact pattern is formed on the first substrate 103*b*, and when the dial 103*a* is rotated, the dial brush 103*c* also rotates at the same time and slides on the contact pattern. By detecting a connection state and a connection time of the dial brush 103*c* on the contact pattern, a rotation amount, position, rotation direction, and the like of the dial 103*a* can be read. Further, it is possible to change settings such as various parameters of the electronic apparatus (in this embodiment, to change a shutter speed, to change an image pickup mode, and the like). A first connection member 105 is attached between the first rotation operation apparatus 103 and the operational feeling control apparatus 101. The dial-side connection member 105*b* is a rotational body, and a rotational force is transmitted between the dial-side connection member 105*b* and the dial 103*a* by a configuration such as a frictional contact or a gear. Similarly, a rotation is transmitted by a configuration such as a frictional contact or a gear between a rotor-side connection member 105*a*, which is attached to the rotor shaft portion 101*c*2, and the dial-side connection member 105*b*.

When the dial 103*a* is rotated, the first rotor 101*c* of the operational feeling control apparatus 101 is rotated via the first connection member 105, and the rotational resistance of the first rotor 101*c* is changed by changing the current flowing through the coil 101*e*1. Thereby, rotational torque of the dial 103*a* can be changed, and a feeling applied to a finger during the rotation can be changed.

Here, regarding the change in the feeling caused by the operational feeling control apparatus 101, when a constant current is continuously applied to the coil 101*e*1, the MR fluids 101*d*1 and 101*d*2 have constant viscosity. Hence, the first rotor 101*c* has constant rotational torque, and when the key top 102*a* or the dial 103*a* is operated, constant operational resistance is always felt. When a time-varying current of a sine wave, a pulse wave, or the like passes through the coil 101*e*1, a time-series torque change can be provided when the first rotor 101*c* is rotated. When a current which changes with time flows in this way, it is possible to provide a pseudo click feeling when the dial 103*a* is rotated.

When a contact sensor (not illustrated) is provided as an operation determiner which detects a finger coming into contact with each operation member, it is possible to detect whether the key top 102*a* or the dial 103*a* is operated as the operation members corresponding to the key top 102*a* and the first rotor 101*c* on a one-to-one basis. When an encoder is provided, and it is determined that the dial 103*a* is being operated by the encoder detecting a change in the control value, the contact sensor may not be provided for the dial 103*a*. In this case, normally, the operational feeling of the key top 102*a* can be controllable, and only when the operation on the dial 103*a* is detected, the setting may be changed so that the operational feeling of the dial 103*a* can be controlled. Thereby, it is possible to control each operational feeling while the contact sensor is not provided for the dial 103*a*.

Regarding the button apparatus 102, when an encoder which is a detector for detecting a moving position is provided and the encoder detects a moving amount of the key top 102*a*, a configuration is realized in which an operation instruction is provided based on the moving amount, without using the switch 102*b*.

There are cases where it is desired to change the characteristics when the operational feelings are controlled depending on a shape, a size, or the like of the operation apparatus. In such a case, depending on the location where the MR fluid is provided, the solvent of the MR fluid may be changed or particle sizes or a content of the iron powders contained in the MR fluid may be changed, so that the changes between initial viscosity and viscosity when the magnetic field is applied can be made different. Thereby, it is possible to provide optimum operational feelings depending on the members for which the operational feelings are controlled.

According to the above description, the MR fluids are provided in a configuration specialized for the operation methods of the plurality of operation members, and one coil provides control on those. Thereby, it is possible to provide a low-cost and small-sized operational feeling control apparatus using an MR fluid. Further, by using this operational feeling control apparatus in an electronic apparatus, it is possible to provide a low-cost and small-sized apparatus which can change operational feelings of a plurality of operation members depending on a preference.

Second Embodiment

Figure 4:
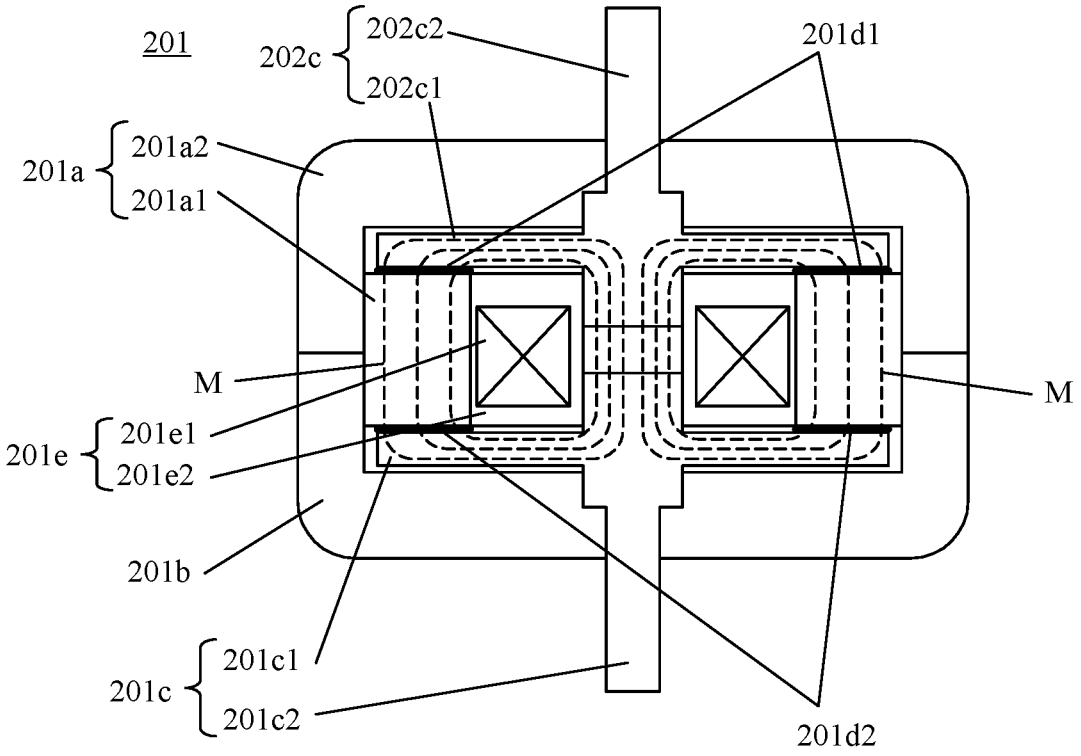
FIG. 4 is a sectional view illustrating an operational feeling control apparatus according to a second embodiment of the present disclosure.

FIG. 4 is a sectional view illustrating an operational feeling control apparatus 201 for realizing a second embodiment of the present disclosure. Corresponding elements with the first embodiment will be designated by the same reference numerals as those in the first embodiment.

As in the first embodiment, a main body unit includes a first main body unit 201*a* and a second main body unit 201*b* each of which also serves as a casing. The first main body unit 201*a* has a structure in which a core portion 201*a*1 and a cover portion 201*a*2 form two bodies. In this configuration, the core portion 201*a*1 is made of magnetic material such as iron, and the cover portion 201*a*2 and the second main body unit 201*b* are made of a non-magnetic material such as resin material. An inner cylinder portion 201*e* is inserted inside the core portion 201*a*1. The inner cylinder portion 201*e* has an integrated structure of a coil 201*e*1 and a holder portion 201*e*2 by enclosing the coil 201*e*1 with the holder portion 201*e*2 of resin material. A second rotor 202*c* as a rotational member is rotatably supported by the first main body unit 201*a*, and the disc portion 202*c*1 disposed on a space surrounded by the core portion 201*a*1, the inner cylinder portion 201*e*, and the cover portion 201*a*2. A gap is formed between the disc portion 202*c*1 of the second rotor 202*c* and the core portion 201*a*1, and an MR fluid 201*d*1 is provided in this gap. The second rotor 202*c* is made of magnetic material, but a rotor shaft portion 202*c*2 connected to the outside may be made of non-magnetic material.

The first rotor 201*c*, which is a rotational member, is rotatably supported by the inner cylinder portion 201*e*. A gap is formed between the disc portion 201*c*1 of the first rotor 201*c* and the core portion 201*a*1, and an MR fluid 201*d*2 is provided in this gap.

The second main body unit 201*b* is attached as a casing for sealing the first rotor 201*c*, and the second main body unit 201*b* is configured to be used as a rotation support member for the first rotor 201*c*. The first rotor 201*c* is made of magnetic material like the second rotor 202*c*, but a rotor shaft portion 201*c*2 connected to the outside may be made of non-magnetic material.

In the operational feeling control apparatus 201 having such a configuration, when a current flows through the coil 201*e*1, a magnetic field M as indicated by dotted lines in FIG. 4 is generated. Since the MR fluids 201*d*1 and 201*d*2 are provided in areas through which the magnetic field M flows, viscosity can be increased by an effect of the magnetic field M. When the viscosity of the MR fluid 201*d*1 increases, viscous resistance occurs between the disc portion 202*c*1 and the MR fluid 201*d*1 when the second rotor 202*c* rotates. When the viscosity of the MR fluid 201*d*2 increases, viscous resistance occurs between disc the portion 201*c*1 and the MR fluid 201*d*2 when the first rotor 201*c* rotates. As described above, each viscous resistance can be changed by changing a value of the current flowing through the coil 201*e*1.

Figure 5B:
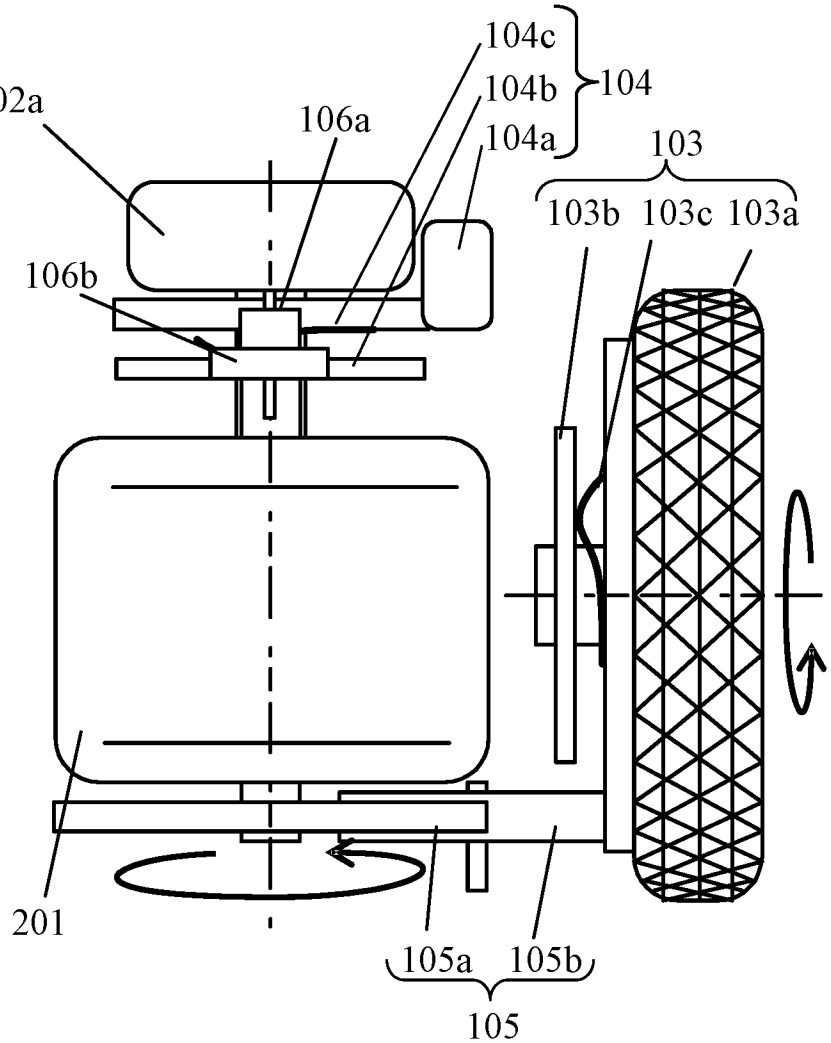
FIGS. 5A and 5B are diagrams each illustrating an example of an electronic apparatus using the operational feeling control apparatus according to the second embodiment of the present disclosure.
Figure 5A:
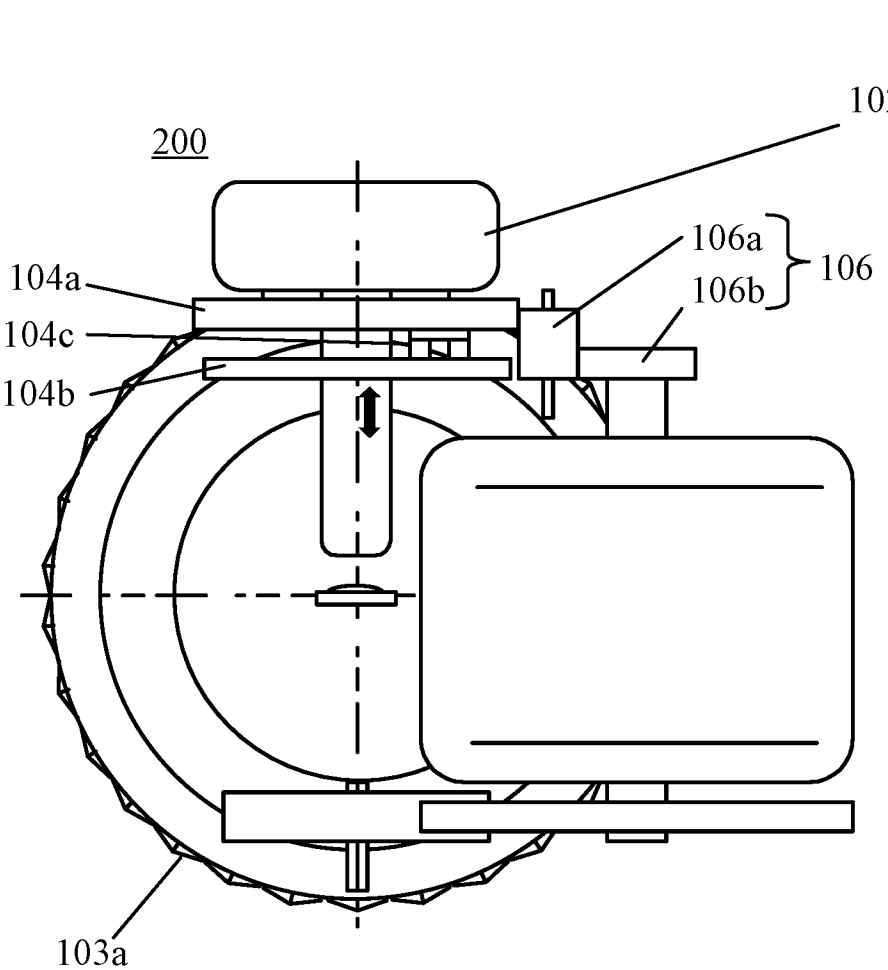

As an example of an electronic apparatus using the operational feeling control apparatus 201 of this configuration, FIGS. 5A and 5B illustrate operation members around a release of a camera to which the operational feeling control apparatus 201 of this configuration is applied. A description will be omitted of an operating principle and an operational feeling control method of a first rotation operation apparatus 103 because the description thereof has been given above. A second rotation operation apparatus 104 is a zoom operation apparatus as it is called in the camera, the zoom operation apparatus changing a focal length of a lens.

The second rotation operation apparatus 104 is attached so that a zoom lever 104*a* as a rotational-lever shaped zoom switch, which is a rotational operation member, rotates on the same axis as a key top 102*a*, and includes a second substrate 104*b*, and a zoom brush 104*c* attached to the zoom lever 104*a*. A contact pattern is formed on the second substrate 104*b*, and when the zoom lever 104*a* is rotated, the zoom brush 104*c* also rotates at the same time and slides on the contact pattern. As in the first rotation operation apparatus 103, a parameter of the electronic apparatus is changed (in this embodiment, the focal length of the lens is changed) by determining a connection state of the zoom brush 104*c* on the contact pattern.

A second connection member 106 is attached between the second rotation operation apparatus 104 and the operational feeling control apparatus 201. A rotational force is transmitted by a frictional contact or a gear structure between a rotor-side connection member 106*b* attached to a rotor shaft portion 202*c*2 of the operational feeling control apparatus 201 and a zoom lever side connection member 106*a* attached to the zoom lever 104*a*.

When the zoom lever 104*a* is rotated, the second rotor 202*c* of the operational feeling control apparatus 201 is rotated via the second connection member 106. At this time, the rotational resistance of the second rotor 202*c* can be changed by changing the current flowing through the coil 201*e*1. Thereby, rotational torque of the zoom lever 104*a* can be changed, and the feeling applied to the finger during rotation can be changed.

As in the embodiment described above, it is also possible to provide a click feeling by a time-varying current flowing through the coil 201*e*1.

As described above, each operation member may include a contact sensor which detects a finger coming into contact with each operation member so that it is detected whether the first rotation operation apparatuses 103 or the second rotation operation apparatus 104 is operated as the operation members corresponding to the first and second rotors 201*c* and 202*c* on a one-to-one. The rotation may be detected by providing an encoder or the like, or the operation may be determined by detecting the change in the control value caused by the operation on the operation member.

According to the above description, the MR fluids are provided in a configuration specialized for the operation methods of the plurality of operation members, and one coil provides control on those. Thereby, it is possible to provide a low-cost and small-sized operational feeling control apparatus using an MR fluid. Further, by using this operational feeling control apparatus in an electronic apparatus, it is possible to provide a low-cost and small-sized apparatus which can change operational feelings of a plurality of operation members depending on a preference.

Third Embodiment

Figure 6:
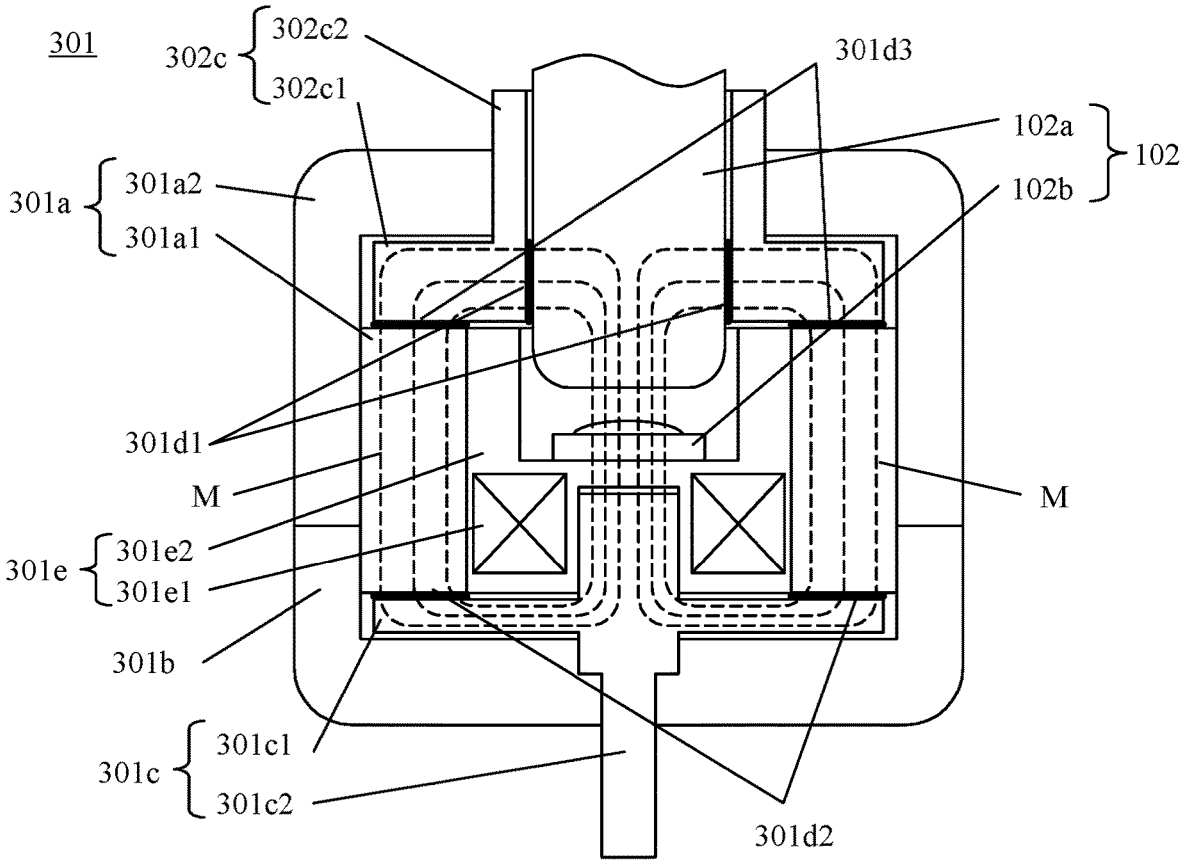
FIG. 6 is a sectional view illustrating an operational feeling control apparatus according to a third embodiment of the present disclosure.

FIG. 6 is a sectional view illustrating an operational feeling control apparatus 301 for realizing a third embodiment of the present disclosure. Corresponding elements with the first and second embodiments will be designated by the same reference numerals as those in the first and second embodiments.

As in the first and second embodiments, a main body unit includes a first main body unit 301*a* and a second main body unit 301*b* each of which also serves as a casing. The first main body unit 301*a* has a structure in which a core portion 301*a*1 and a cover portion 301*a*2 form two bodies. In this configuration, the core portion 301*a*1 is made of magnetic material such as iron, and the cover portion 301*a*2 and the second main body unit 301*b* are made of non-magnetic material such as resin material. An inner cylinder portion 301*e* is inserted inside the core portion 301*a*1. The inner cylinder portion 301*e* has an integrated structure of a coil 301*e*1 and a holder portion 301*e*2 by enclosing the coil 301*e*1 with the holder portion 301*e*2 of resin material.

A second rotor 302*c*, which is a rotational member, is rotatably supported by the cover portion 301*a*2. A key top 102*a*, which is a linearly moving member, is disposed on the same axis as the second rotor 302*c* so that the key top 102*a* fits the second rotor 302*c*. The key top 102*a* is a part included in a button apparatus 102, and is a linear operation member which slides in a vertical direction of FIG. 6. The second rotor 302*c* is made of magnetic material, but a rotor shaft portion 302*c*2 connected to the outside may be made of non-magnetic material.

A gap is formed between the key top 102*a* and the second rotor 302*c*, and an MR fluid 301*d*1 is provided in this gap. A gap is also formed between the second rotor 302*c* and the core portion 301*a*1, and an MR fluid 301*d*3 is provided in this gap. Although the drawings describe such that the MR fluids 301*d*1 and 301*d*3 are separately arranged, they may be integrally provided, that is, an MR fluid may also be provided between the inner cylinder portion 301*e* and the disc portion 302*c*2.

The first rotor 301*c*, which is a rotational member, is rotatably supported by the inner cylinder portion 301*e*. A gap is formed between a disc portion 301*c*1 of the first rotor 301*c* and the core portion 301*a*1, and an MR fluid 301*d*2 is provided in this gap.

The second main body unit 301*b* is attached as a casing for sealing the first rotor 301*c*, and the second main body unit 301*b* is configured to be used as a rotation support member for the first rotor 301*c*. The first rotor 301*c* is made of magnetic material like the second rotor 302*c*, but a rotor shaft portion 301*c*2 connected to the outside may be made of non-magnetic material.

In the operational feeling control apparatus 301 having such a configuration, when a current flows through the coil 301*e*1, a magnetic field M as indicated by dotted lines in FIG. 6 is generated. Since the MR fluids 301*d*1, 301*d*2 and 301*d*3 are provided in areas through which the magnetic field M passes, viscosity can be changed by an effect of the magnetic field M. When the viscosity of the MR fluid 301*d*1 increases, viscous resistance occurs when the key top 102*a* linearly moves. When the viscosity of the MR fluid 301*d*2 increases, viscous resistance occurs between the disc portion 301*c*1 and the MR fluid 301*d*2 when the first rotor 301*c* rotates. When the viscosity of the MR fluid 301*d*3 increases, viscous resistance is generated between the disc portion 302*c*1 and the MR fluid 301*d*2 when the second rotor 302*c* rotates. Further, as described above, each viscous resistance can be changed by changing a value of the current flowing through the coil 301*e*1.

Here, the MR fluid 301*d*3 is provided to control the second rotor 302*c*, but in this configuration, when the MR fluid 301*d*1 is provided, the control is collectively provided on the operational feelings of the key top 102*a* and the second rotor 302*c*. Therefore, the MR fluid 301*d*3 may not be provided. However, since the MR fluid 301*d*1 is provided on an inner diameter portion of the second rotor 302*c*, the MR fluid 301*d*1 may not be able to finely control the second rotor 302*c*. Hence, when the MR fluid 301*d*3 is provided on a portion having a larger diameter than the diameter of the second rotor 302*c*, it is possible to provide a necessary control.

Figure 7B:
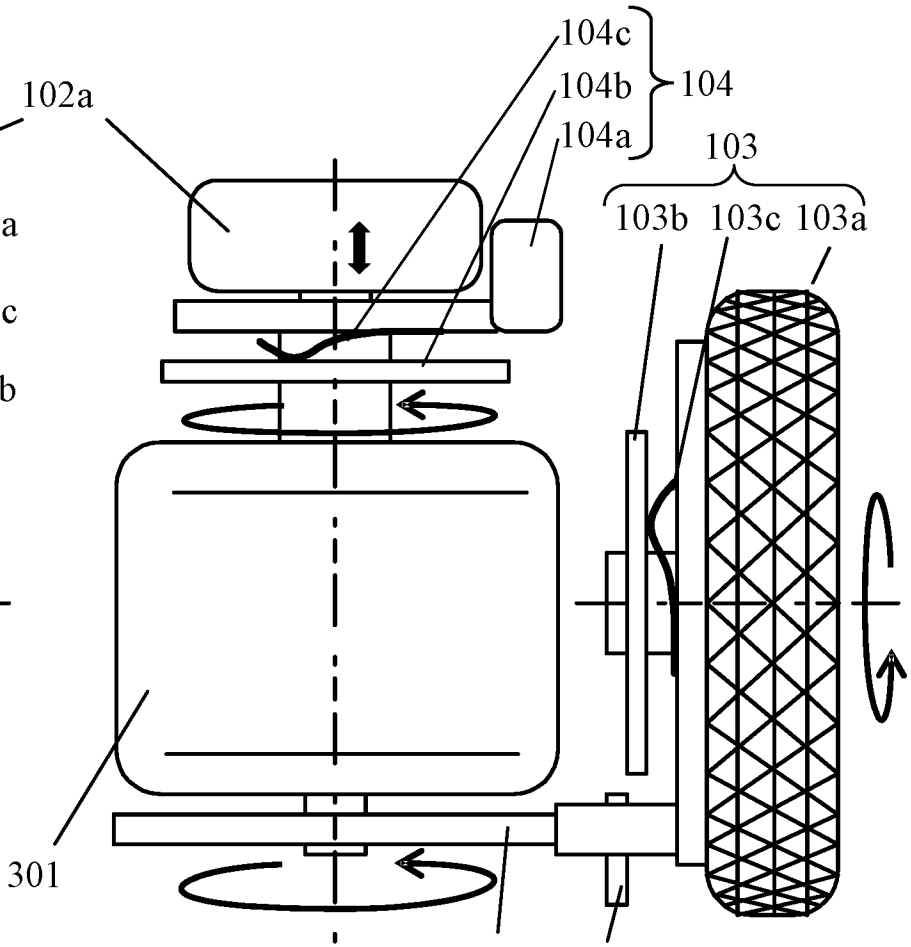
FIGS. 7A and 7B are diagrams each illustrating an example of an electronic apparatus using the operational feeling control apparatus according to the third embodiment of the present disclosure.
Figure 7A:
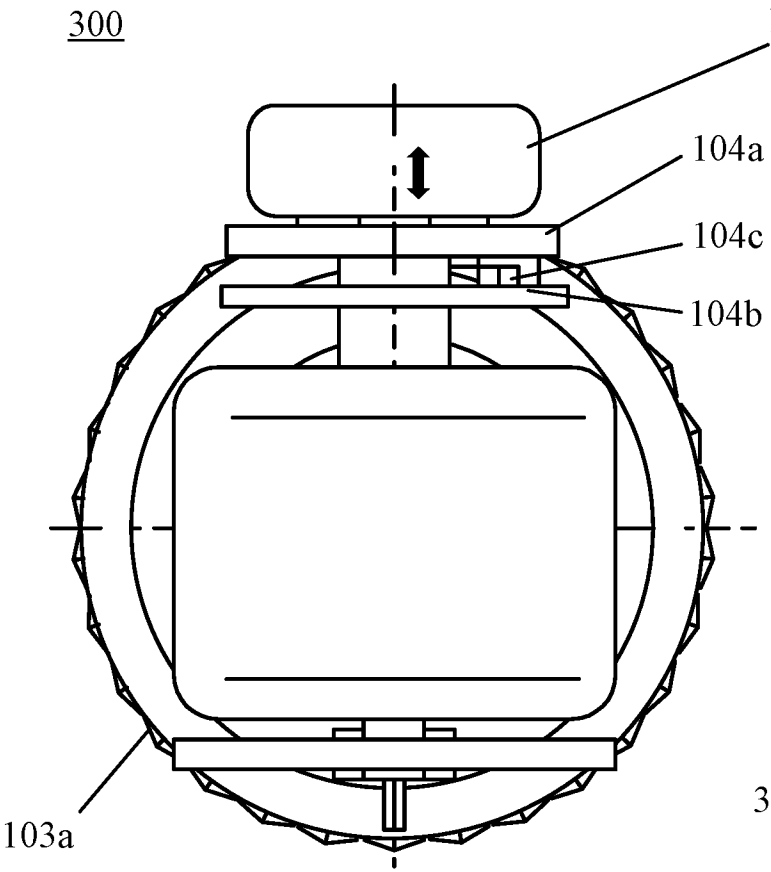

As an example of an electronic apparatus using the operational feeling control apparatus 301 of this configuration, FIGS. 7A and 7B illustrate operation members around a release of a camera to which the operational feeling control apparatus 301 of this configuration is applied. The key top 102*a* of the button apparatus 102, which is a release apparatus, is inserted into the operational feeling control apparatus 301.

A description will be omitted of an operating principle and an operational feeling control method of a first rotation operation apparatus 103 because the description thereof has been given above.

A second rotation operation apparatus 104 is a zoom operation apparatus as it is called in the camera, the zoom operation apparatus changing a focal length of a lens. A zoom lever 104*a*, which is a rotational operation member of the second rotation operation apparatus 104, is attached so that the zoom lever 104*a* rotationally moves on the same axis as the key top 102*a*. The rotor shaft portion 302*c*2 of the second rotor 302*c* is also disposed on the same axis as the key top 102*a* as in the zoom lever 104*a*, and is connected to the zoom lever 104*a* so that they integrally rotate. Thereby, when the zoom lever 104*a* is rotated, the second rotor 302*c* rotates at the same time, and thus the feeling at the time of rotation can be changed by changing the viscosity of the MR fluid 301*d*3.

As described above, controls using the MR fluids 301*d*1 and 301*d*2 can change operational feelings of the button apparatus 102 and the second rotation operation apparatus 104, respectively.

According to the above description, the MR fluids are provided in a configuration specialized for the operation methods of the plurality of operation members, and one coil provides control on those. Thereby, it is possible to provide a low-cost and small-sized operational feeling control apparatus using an MR fluid. Further, by using this operational feeling control apparatus in an electronic apparatus, it is possible to provide a low-cost and small-sized apparatus which can change operational feelings of a plurality of operation members depending on a preference.

Fourth Embodiment

Figure 8A:
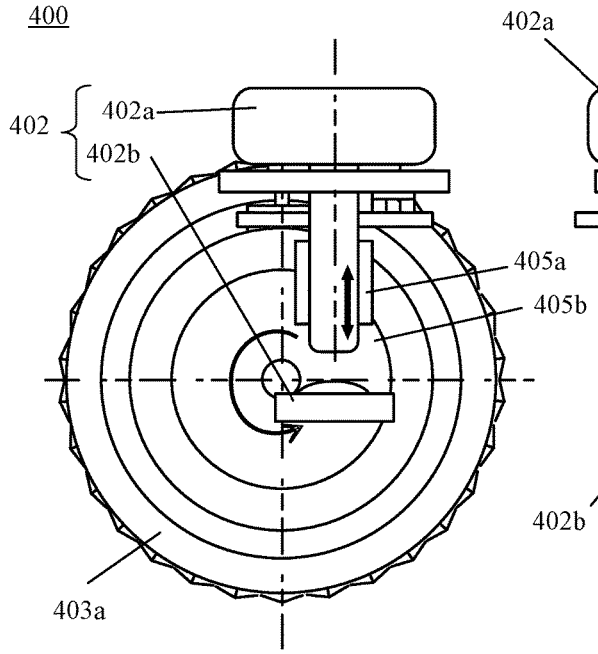
FIGS. 8A and 8B are diagrams each illustrating an operation unit according to a fourth embodiment of the present disclosure.
Figure 8B:
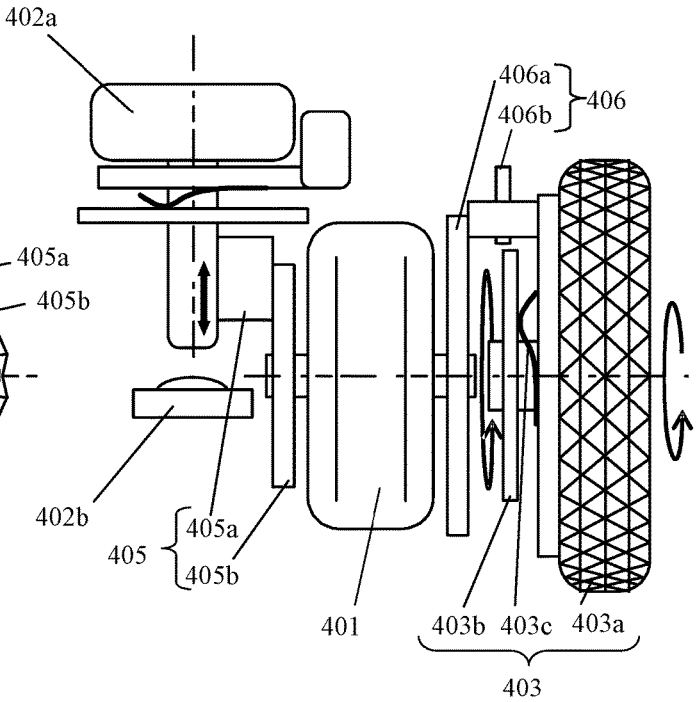

FIGS. 8A and 8B are diagrams each illustrating an operation unit 400 on an electronic apparatus for realizing a fourth embodiment of the present disclosure. In FIGS. 8A and 8B, a reference numeral 401 denotes an operational feeling control apparatus as a control apparatus in which an MR fluid is provided and which provides control on a feeling of each operation unit. A reference numeral 402 denotes a button apparatus as a linear operation member which linearly moves by a pressing operation, and a reference numeral 403 denotes a first rotational operation member for changing a parameter of an electronic apparatus by a rotational operation. A moving axis of the button apparatus 402, which is a linear operation member, and a rotational axis of the first rotational operation member 403 are different axes.

Figure 9:
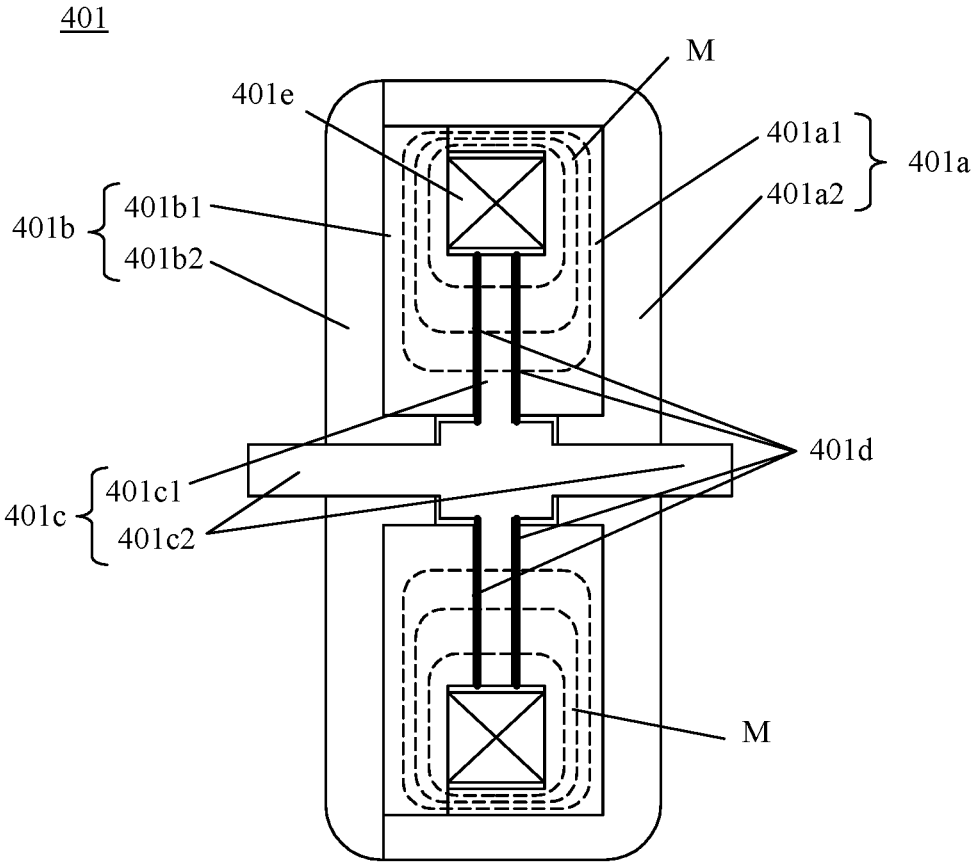
FIG. 9 is a diagram illustrating a section of the operation unit according to the fourth embodiment of the present disclosure.

FIG. 9 is a sectional view illustrating an operational feeling control apparatus 401. In the operational feeling control apparatus 401, a main body unit of the operational feeling control apparatus 401 includes a first main body unit 401*a*, a second main body unit 401*b* each of which also serves as a casing, and a rotor 401*c* which is a rotational member rotatably supported by the second main body unit 401*b*. The first main body unit 4011*a* has a two-body structure, and includes a core portion 401*a*1 and a cover portion 401*a*2. In this configuration, the core portion 401*a*1 is made of magnetic material such as iron, and the cover portion 401*a*2 is made of non-magnetic material such as resin material. The second main body unit 401*b* also has a two-body structure of the similar configuration. The first and second main body units 401*a* and 401*b* may be made of the same material and may be integrated. Gaps are respectively formed between the core portion 401*a*1 of the first main body unit 401*a* and a disc portion 401*c*1 of the rotor 401*c*, and between the core portion 401*b*1 of the second main body unit 401*b* and the disc portion 401*c*1 of the rotor 401*c*, and an MR fluid 401*d* is provided in each gap. A coil 401*e*, which is a magnetic field generator, is disposed on an outer periphery of the disc portion 401*c*1 of the rotor 401*c*. When a current flows through the coil 401*e*, a magnetic field M as indicated by dotted lines in FIG. 9 is generated. Since the MR fluid 401*d* is provided in areas through which the magnetic field M passes, viscosity of the MR fluid 401*d* increases by an effect of the magnetic field M, and when the rotor 401*c* rotates, viscous resistance can be generated between the disc portion 401*c*1 and the MR fluid 401*d*. The MR fluid 401*d* has a characteristic that the viscosity increases as a current value flowing through the coil 401*e* increases, and therefore the rotational resistance of the rotor 401*c* can be changed by changing a current value flowing through the coil 401*e*.

FIGS. 8A and 8B specifically illustrate an operation unit 400 around a release of a camera as an electronic apparatus to which the operational feeling control apparatus 401 according to this embodiment is applied. A button apparatus 402 has a push-button shape, and is a release apparatus of the camera in which a switch is turned on when a release button 401*a* presses a release switch 402*b* which is a switch member. Electrical on/off of the switch can be changed by operating the release switch 402*b*. A first connection member 405 is disposed between the release button 402*a* and the operational feeling control apparatus 401, and the rotor shaft portion 401*c*2 of the release button 402*a* and the operational feeling control apparatus 401 is connected via the first connection member 405. The first connection member 405 transmits a driving force of the rotor 401*c* to the release button 402*a* of the button apparatus 402. A button-side connection member 405*a* attached to the release button 402*a* linearly moves, and a rotor-side connection member 405*b* attached to the rotor shaft portion 401*c*2 rotates. For example, both the button-side connection member 405*a* and the rotor-side connection member 405*b* are made of material having a large surface friction coefficient such as rubber. Alternatively, for example, the button-side connection member 405*a* is configured as a rack, the rotor-side connection member 405*b* is configured as a pinion, and they are configured to engage with each other. In this configuration, the first connection member 405 can have a conversion mechanism for converting a linear motion operation into a rotational motion operation.

When the release button 402*a* is pressed, the rotor 401*c* of the operational feeling control apparatus 401 is rotated via the first connection member 405. As illustrated in FIG. 2, when the current flowing through the coil 401*e* is T1, a shear stress of the MR fluid 401*d* becomes σ1, and rotational resistance R1 is generated in the rotor 401*c*. Thereby, when the release button 402*a* is pressed, a predetermined resistance is felt. When the current flowing through the coil 401*e* is T2 which is higher than T1, the shear stress of the MR fluid 401*d* becomes σ2 which is higher than σ1, and the rotational resistance R2 (R2>R1) occurs in the rotor 401*c*. Thus, a larger force is required to rotate the rotor 401*c* as compared with the case where the current flowing through the coil 401*e* is T1, larger resistance is felt when the release button 402*a* is pressed, and the pressing feeling of the release button 402*a* can be changed.

The first rotational operation member 403 includes a dial 403*a* which is a rotational operation member having a dial shape, the first substrate 403*b*, and a dial brush 403*c* attached to the dial 403*a*. A contact pattern is formed on the first substrate 403*b*, and when the dial 403*a* is rotated, the dial brush 403*c* also rotates at the same time and slides on the contact pattern. By detecting a connection state and a connection time of the dial brush 403*c* on the contact pattern, a rotation amount, a position, a rotation direction, and the like of the dial 403*a* can be read, and it is possible to change various parameters of the electronic apparatus (in this embodiment, to change a shutter speed, to change an image pickup mode, and the like). A second connection member 406 is attached between the first rotational operation member 403 and the operational feeling control apparatus 401. A dial-side connection member 406*a* is a rotating body, and a rotation is transmitted between the dial-side connection member 406*a* and the dial 403*a* by a configuration such as a frictional contact or a gear. Similarly, a rotation is transmitted between the dial-side connection member 406*a* and a rotor-side connection member 406*b* attached to the rotor shaft portion 401*c*2 by a configuration such as a frictional contact or a gear.

When the dial 403*a* is rotated, the rotor 401*c* of the operational feeling control apparatus 401 is rotated via the second connection member 406, and thus the rotational resistance of the rotor 401*c* can be changed by changing the current flowing through the coil 401*e*. Rotational torque of the dial 403*a* can be changed, and a feeling applied to a finger during a rotation can be changed.

Here, regarding the change in the feeling caused by the operational feeling control apparatus 401, when a constant current is continuously applied to the coil 401*e*, the MR fluid 401*d* has constant viscosity, and the rotor 401*c* has constant rotational torque. Therefore, when the release button 402*a* or the dial 403*a* is operated, constant operational resistance is always felt. When a time-varying current of a sine wave, a pulse wave, or the like passes through the coil 401*e*, a time-series torque change can be provided when the rotor 401*c* is rotated. When a current which changes with time flows in this way, it is possible to provide a pseudo click feeling when the dial 403*a* is rotated.

The operational feeling control apparatus 401 used in this configuration has a structure in which the rotor shaft portion 401*c*2 of the rotor 401*c* extends to both sides. Therefore, when the operational feeling control apparatus 401 is disposed between the release button 402*a* and the first rotational operation member 403, it is possible to connect those apparatuses with a simple configuration. Thereby, the operational feeling control apparatus 401 can be efficiently disposed even in a small space, and the small size can be realized.

The dial 403*a* is a rotating body, and in this configuration, the rotational axis of the dial 403*a* and the rotational axis of the rotor 401*c* are arranged on the same axis. Therefore, the axis of the dial 403*a* and the rotor shaft portion 401*c*2 may be directly connected without the second connection member 406.

Next, as described in this configuration, if the first connection member 405 and the second connection member 406 are always connected, when the dial 403*a* is rotated, a rotational force is transmitted to the first connection member 405, and thus the release button 402*a* may move. In order that such a state is avoided, it is necessary to use a configuration such that when the rotation of the dial 403*a* is detected, the button-side connection member 405*a* and the rotor-side connection member 405*b* are disconnected in the first connection member 405. When they are connected by a frictional force, the contact resistance is set so that when the rotational force of the dial 403*a* is applied, the button-side connection member 405*a* and the rotor-side connection member 405*b* slip on each other, and that when the release button 402*a* is operated, they are connected to each other. By such a configuration, no operational problem occurs even if the connection is not completely disconnected. In this way, the first connection member 405 and the second connection member 406 are configured so that when it is determined that one of the dial 403*a* and the release button 402*a* is operated, the connection between the other and the rotor 401*c* is disconnected. The first connection member 405 and the second connection member 406 may be configured so that when it is determined that one of the dial 403*a* and the release button 402*a* is operated, the other is fixed and is prevented from being operated. The first connection member 405 and the second connection member 406 may be configured so that when it is determined that one of the dial 403*a* and the release button 402*a* is operated, even if the other is operated, the control on the electronic apparatus and the change in parameters, each of which is based on the operation on the other, is ignored.

When a contact sensor (not illustrated) is provided as an operation determiner which detects a finger coming into contact with each operation member, it is possible to detect whether the release button 402*a* or the dial 403*a* is operated.

When an encoder is provided, and it is determined that the dial 403*a* is being operated by the encoder detecting a change in the control value, the contact sensor may not be provided for the dial 403*a*. In this case, normally, the operational feeling of the release button 402*a* can be controllable, and only when the operation on the dial 403*a* is detected, the setting may be changed so that the operational feeling of the dial 403*a* can be controlled. Thereby, it is possible to control each operational feeling while the contact sensor is not provided for the dial 403*a*.

Regarding the button apparatus 402, when an encoder which is a detector for detecting a moving position is provided and the encoder detects a moving amount of the release button 402*a*, a configuration is realized in which an operation instruction is provided based on the moving amount, without using the release switch 402*b*.

According to the above description, it is possible to provide a low-cost and small-sized operation unit which controls a plurality of operation members including a linear operation member with one operational feeling control apparatus, and an electronic apparatus having the same.

Fifth Embodiment

Figure 10B:
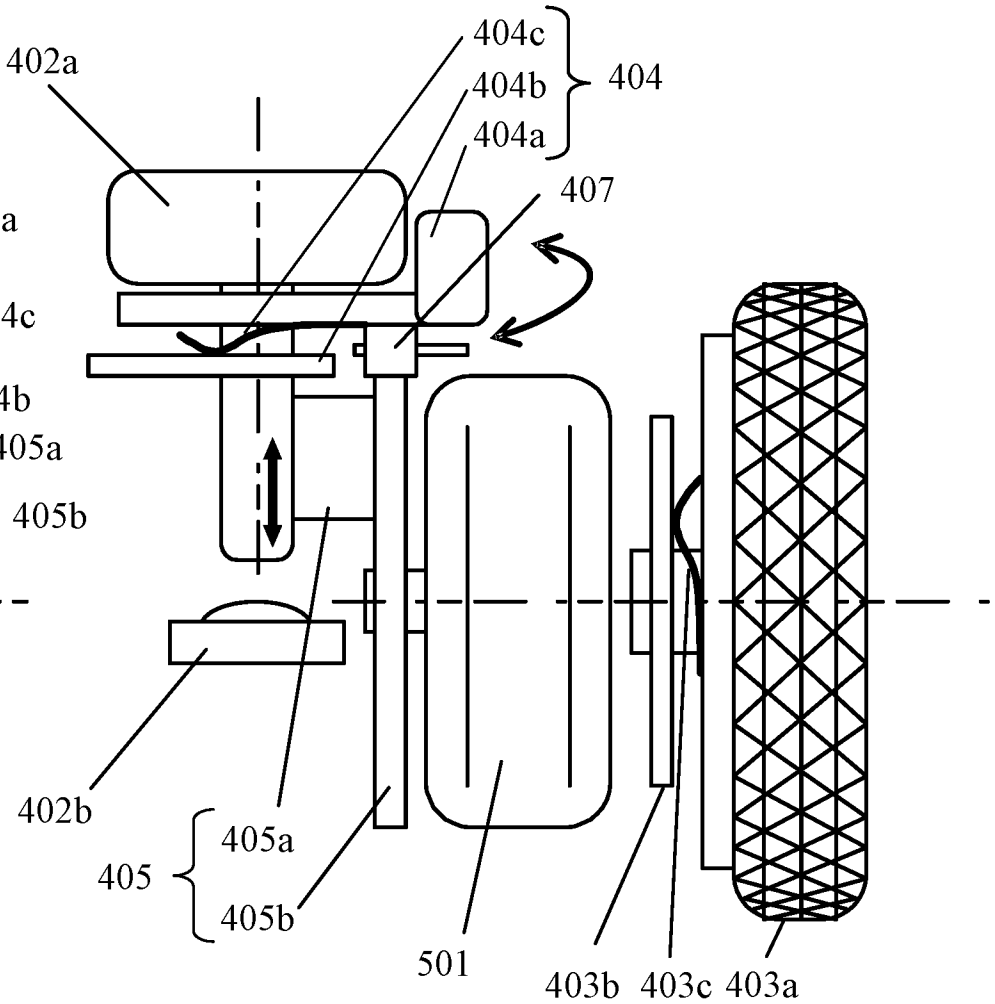
FIGS. 10A and 10B are diagrams each illustrating an operation unit according to a fifth embodiment of the present disclosure.
Figure 10A:
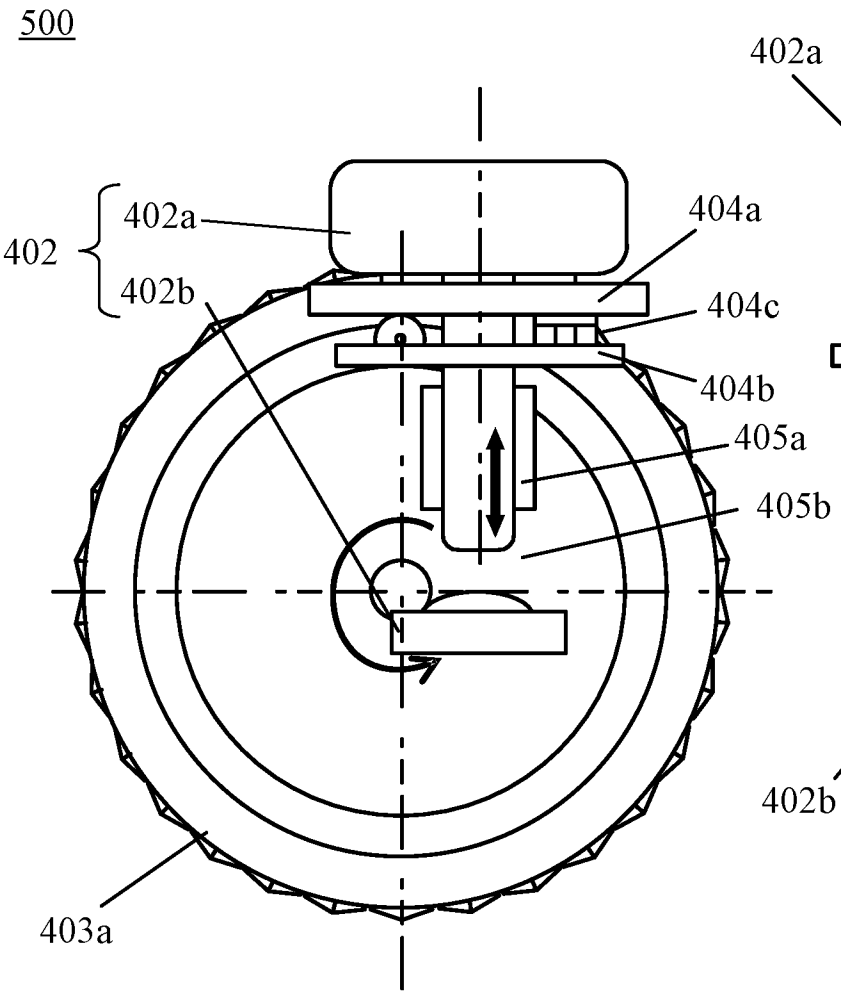

FIGS. 10A and 10B are diagrams illustrating an operation unit 500 on an electronic apparatus for realizing a fifth embodiment of the present disclosure. Corresponding elements with the fourth embodiment will be designated by the same reference numerals as those in the fourth embodiment. A reference numeral 404 denotes a second rotational operation member which is disposed around a release button 402*a*, and is operated for changing a parameter of the electronic apparatus by a rotational operation. A moving axis of a button apparatus 402, which is a linear operation member, and a rotational axis of the second rotational operation member 404 are the same axis.

Figure 11:
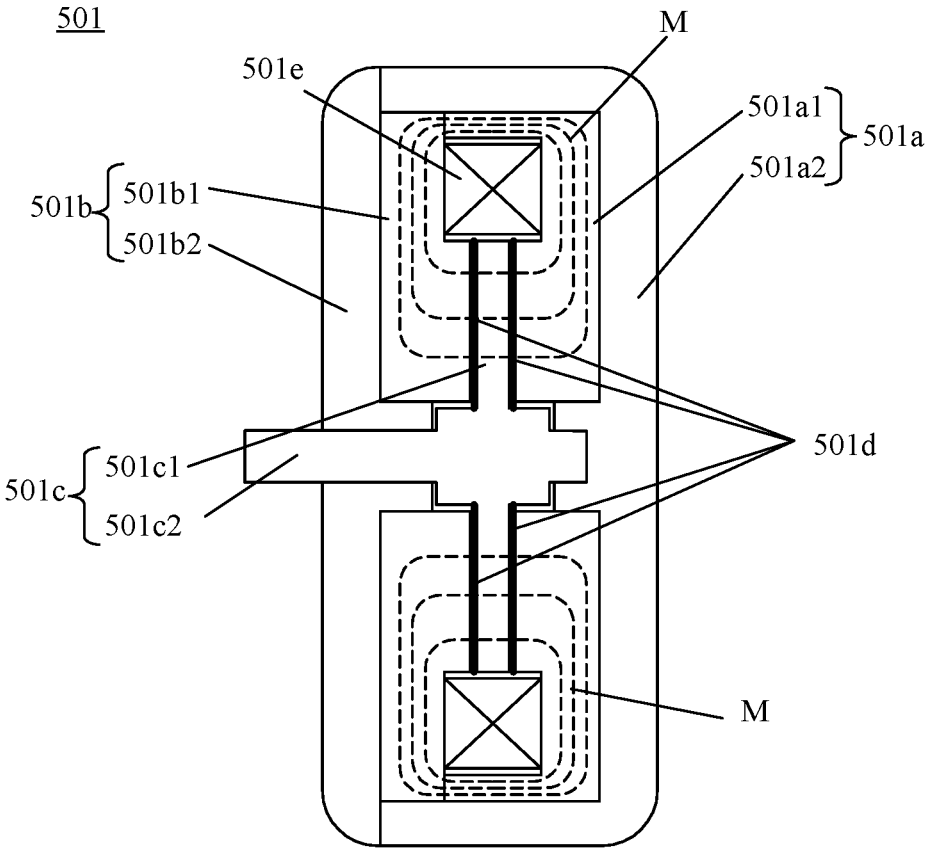
FIG. 11 is a diagram illustrating a section of the operation unit according to the fifth embodiment of the present disclosure.

An operational feeling control apparatus 501 is used for the operation unit 500 on an electronic apparatus described in this embodiment. As illustrated in FIG. 11, the operational feeling control apparatus 501 is different from the operational feeling control apparatus of the fourth embodiment, and includes a rotor shaft portion 501*c*2 extending only from one side.

The second rotational operation member 404 is a zoom operation apparatus as it is called in a camera, the zoom operation apparatus being configured to change a focal length of a lens.

As illustrated in FIGS. 10A and 10B, a description will be omitted of an operation principle and an operational feeling control method of the button apparatus 402, because the description thereof has been given above. In this configuration, as well as a button-side connection member 405*a*, a third connection member 407 is connected to a rotor-side connection member 405*b*. The second rotational operation member 404 is attached so that a rotational-lever shaped zoom lever 404*a* as a zoom switch, which is a rotational operation member, rotates on the same axis as the release button 402*a*, and the second rotational operation member 404 includes a second substrate 404*b*, and a zoom brush 404*c* attached to the zoom lever 404*a*. A contact pattern is formed on the second substrate 404*b*, and when the zoom lever 404*a* is rotated, the zoom brush 404*c* also rotates at the same time and slides on the contact pattern. As in the first rotational operation member 403, a parameter of the electronic apparatus is changed (in this embodiment, the focal length of the lens is changed) by determining a connection state of the zoom brush 404*c* on the contact pattern.

A third connection member 407 is attached between the second rotational operation member 404 and the operational feeling control apparatus 501. The third connection member 407 is a rotating body, and a rotational force is transmitted between the connection member 407 and the zoom lever 404*a* by a configuration such as a frictional contact or a gear.

When the zoom lever 404*a* is rotated, a rotor 501*c* as a rotational member of the operational feeling control apparatus 501 is rotated via the third connection member 407. At this time, rotation torque of the rotor 501*c* can be changed by changing a current flowing through a coil 501*e*, and thus it is possible to change a feeling applied to a finger when the zoom lever 404*a* is rotated.

As in the fourth embodiment, it is also possible to provide a click feeling by a time-varying current flowing through the coil 501*e*.

In this configuration, the first rotational operation member 403 and the operational feeling control apparatus 501 are not connected, and thus the rotor shaft portion 501*c*2 extends only from one side of the operational feeling control apparatus 501. Thereby, when the operational feeling control apparatus 501 is disposed between the release button 402*a* and the first rotational operation member 403, it is possible to reduce a space between the first rotational operation member 403 and the operational feeling control apparatus 501 as compared with the fourth embodiment. Therefore, it is possible to realize the smaller size.

In this configuration as well, as in the fourth embodiment, a connection member may be retracted or locked so that an operation apparatus which is not operated does not move.

According to the above description, it is possible to provide a low-cost and small-sized operation unit which controls a plurality of operation members including a linear operation member with one operational feeling control apparatus, and an electronic apparatus having the same.

Sixth Embodiment

Figure 12B:
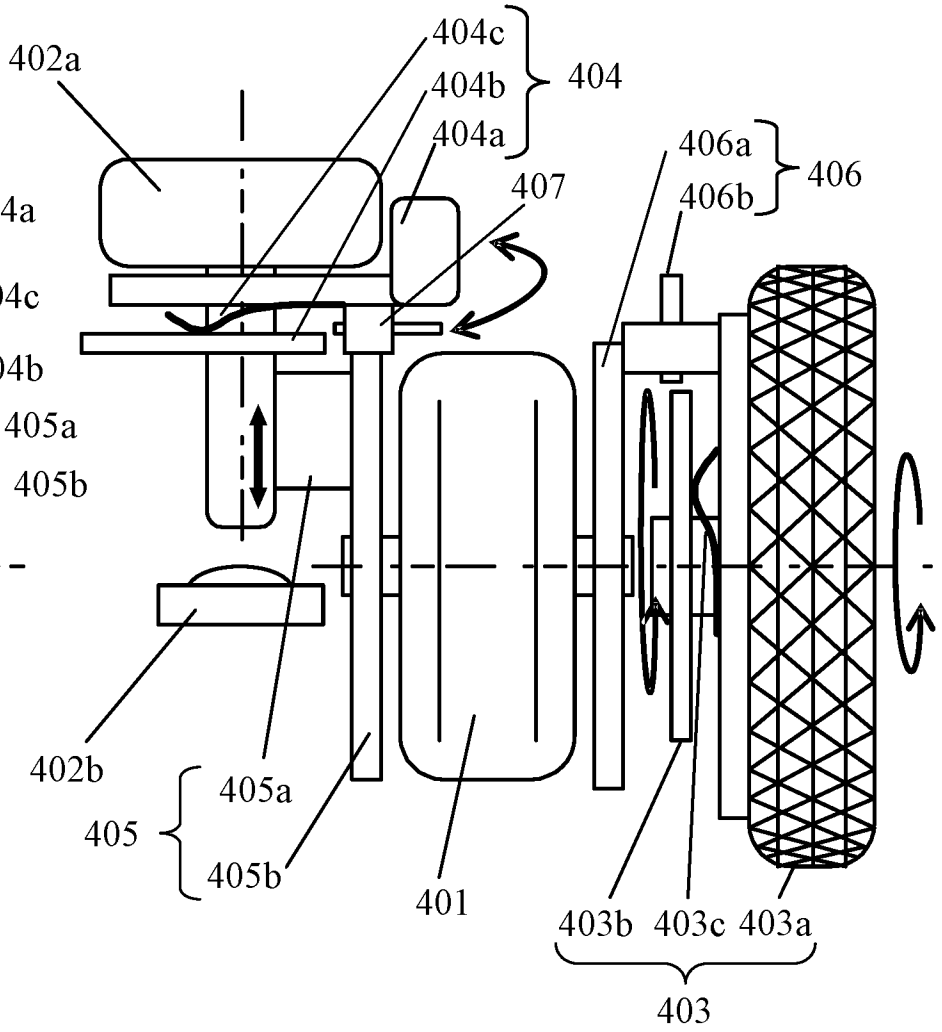
FIGS. 12A and 12B are diagrams each illustrating an operation unit according to a sixth embodiment of the present disclosure.
Figure 12A:
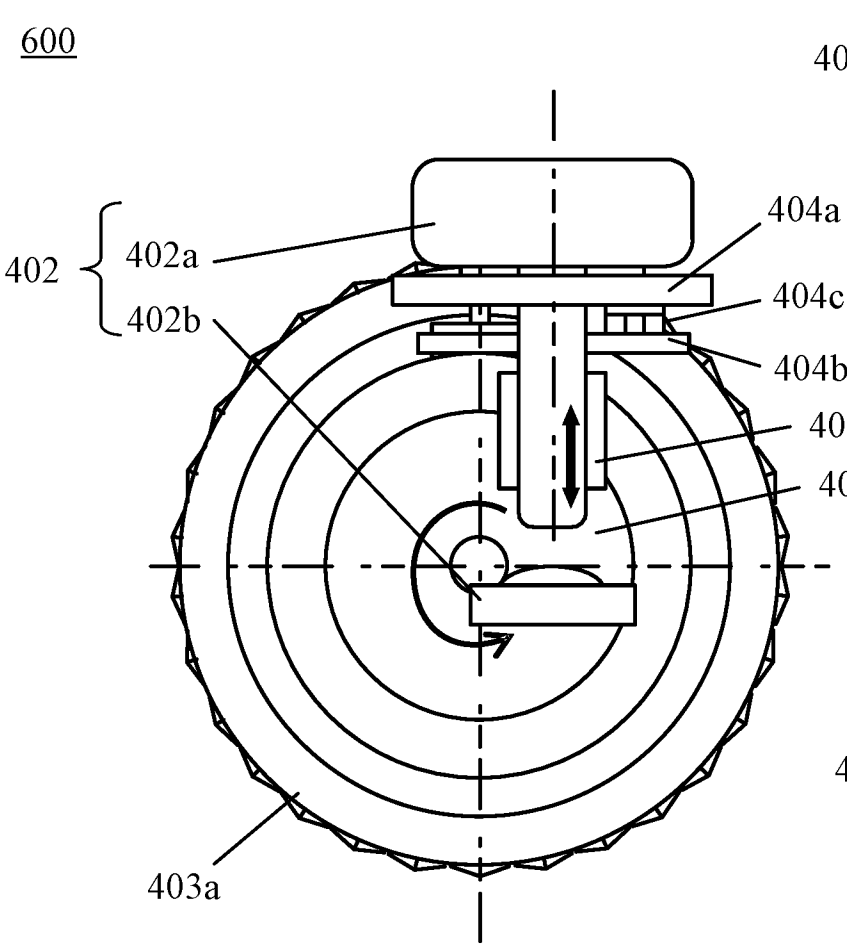

FIGS. 12A and 12B are diagrams illustrating an operation unit 600 on an electronic apparatus for realizing a sixth embodiment of the present disclosure. Corresponding elements with the fourth and fifth embodiments will be designated by the same reference numerals as those in the fourth and fifth embodiments.

The operation unit 600 on the electronic apparatus in this embodiment is a combination of configurations of the fourth and fifth embodiments.

To an operational feeling control apparatus 401, a button apparatus 402 is connected via a first connection member 405, a first rotational operation member 403 is connected via a second connection member 406, and a second rotational operation member 404 is connected via a third connection member 407.

Thereby, an operational feeling of each of the three operation members of a release button 402*a*, a dial 403*a*, and a zoom lever 404*a* can be controlled by using the operational feeling control apparatus 401.

Also in this configuration, it is not possible to determine how to control the operational feeling unless which operation member is operated is detected. Therefore, this determination is made by providing, for each operation member, an encoder or a contact sensor, which detects a finger coming into contact, or by detecting a change in a control value caused by an operation on each operation member. Thereby it is possible to properly control an operational feeling.

In this configuration as well, as in the fourth and fifth embodiments, a connection member may be retracted or locked so that an operation apparatus which is not operated does not move.

According to the above description, it is possible to provide a low-cost and small-sized operation unit which controls a plurality of operation members including a linear operation member with one operational feeling control apparatus, and an electronic apparatus having the same.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-111108, filed on Jun. 29, 2020 and Japanese Patent Application No. 2020-111098, filed on Jun. 29, 2020 which are hereby incorporated by reference herein in their entirety.

What is claimed is:

1. An imaging apparatus comprising:

a control apparatus including:

a main body unit;

a plurality of moving members disposed at a plurality of different positions of the main body unit and movably supported by the main body unit;

magneto rheological fluid disposed at a plurality of positions each of which is located between the main body unit and any of the plurality of moving members or between the plurality of moving members; and a common magnetic field generator for applying a magnetic field to the magneto rheological fluid disposed at the plurality of positions; and a plurality of operation members, wherein the common magnetic field generator and the magneto rheological fluid are included inside a single casing, and the plurality of moving members are inserted into the single casing, wherein the plurality of operation members and the plurality of moving members are connected to each other on a one-to-one basis, wherein viscous resistance of the magneto rheological fluid differs depending on a position of the magneto rheological fluid, and wherein the control apparatus can change the viscous resistance, which differs depending on the position, of the magneto rheological fluid by changing a current value applied to the common magnetic field generator, and thereby can provide control that changes resistance against an operation on each of the plurality of operation members.

2. The imaging apparatus according to claim 1, wherein the plurality of operation members include a release button, and wherein the magneto rheological fluid is provided at a bottom side of a key top formed on the release button.

3. The imaging apparatus according to claim 1, wherein the plurality of operation members are a plurality of rotational operation members, respectively, wherein the plurality of moving members are a plurality of rotors, respectively, and wherein the plurality of rotors are made of magnetic material.

4. The imaging apparatus according to claim 3, wherein the common magnetic field generator faces the plurality of rotors made of the magnetic material at respective facing positions different from each other, wherein the magneto rheological fluid is provided between the common magnetic field generator and the plurality of rotors facing at the respective facing positions, and wherein the viscous resistance of the magneto rheological fluid differs at the different facing positions.

* * * * *